US007812768B2

(12) United States Patent
Liu et al.

(10) Patent No.: US 7,812,768 B2
(45) Date of Patent: Oct. 12, 2010

(54) MULTIPLE INPUT MULTIPLE OUTPUT ANTENNA

(75) Inventors: Xiao-Feng Liu, Shenzhen (CN); Cho-Ju Chung, Taipei Hsien (TW); Teng-Huei Chu, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 283 days.

(21) Appl. No.: 12/185,107

(22) Filed: Aug. 3, 2008

(65) Prior Publication Data

US 2009/0267857 A1 Oct. 29, 2009

(30) Foreign Application Priority Data

Apr. 28, 2008 (CN) ..... 2008 1 0301365

(51) Int. Cl.
*H01Q 1/38* (2006.01)
*H01Q 9/28* (2006.01)

(52) U.S. Cl. ..... 343/700 MS; 343/795

(58) Field of Classification Search ..... 343/700 MS, 343/795, 893, 878
See application file for complete search history.

(56) References Cited

U.S. PATENT DOCUMENTS

| | | | | |
|---|---|---|---|---|
| 7,561,110 | B2 * | 7/2009 | Chen | 343/702 |
| 2008/0268908 | A1 * | 10/2008 | Chen | 455/562.1 |
| 2009/0174617 | A1 * | 7/2009 | Chen | 343/727 |

FOREIGN PATENT DOCUMENTS

| | | |
|---|---|---|
| CN | 100349325 C | 11/2007 |
| TW | M302781 | 12/2006 |

* cited by examiner

*Primary Examiner*—Shih-Chao Chen
(74) *Attorney, Agent, or Firm*—Frank R. Niranjan

(57) ABSTRACT

A MIMO antenna (20) is disposed on a substrate (10) including a first surface (12) and a second surface (14). The MIMO antenna includes a pair of parallel first antennas (30) spaced apart from each other and a second antenna (40) spaced apart from the first antennas. The second antenna is disposed between the first antennas. Each of the first and second antennas is disposed on the first and second surface of the substrate and is a dipole antenna.

18 Claims, 13 Drawing Sheets

MULTIPLE INPUT MULTIPLE OUTPUT ANTENNA

BACKGROUND

1. Field of the Invention

The invention relates to multiple input multiple output (MIMO) antennas, and particularly to a MIMO antenna with dipole antennas.

2. Description of Related Art

In wireless communication systems, as the number of users continue to increase, data traffic becomes an increasingly more important concern. As a result, it is important to research methods of increasing the capacity of such wireless communication systems to meet future demands.

A relatively new radio communications technology, multiple input multiple output (MIMO) systems, provides increased system capacity. A number of antennas are used on both the transmitter and receiver. When combined with appropriate beam forming and signal processing technologies, these antennas are capable of providing two or more orthogonal radio propagation channels between the two antennas. The antennas are spaced apart in order to decorrelate the signals associated with adjacent antennas.

There is, accordingly, a need for improved antenna arrangements for use with MIMO systems.

SUMMARY

In an exemplary embodiment, a MIMO antenna disposed on a substrate includes a first surface and a second surface. The MIMO antenna includes a pair of parallel first antennas spaced apart from each other, and a second antenna spaced apart from the first antennas. The second antenna is disposed between the first antennas. Each of the first and second antennas is disposed on the first and second surfaces of the substrate, and is a dipole antenna.

Other advantages and novel features will become more apparent from the following detailed description when taken in conjunction with the accompanying drawings, in which:

DETAILED DESCRIPTION OF THE EMBODIMENTS

Figure 1:
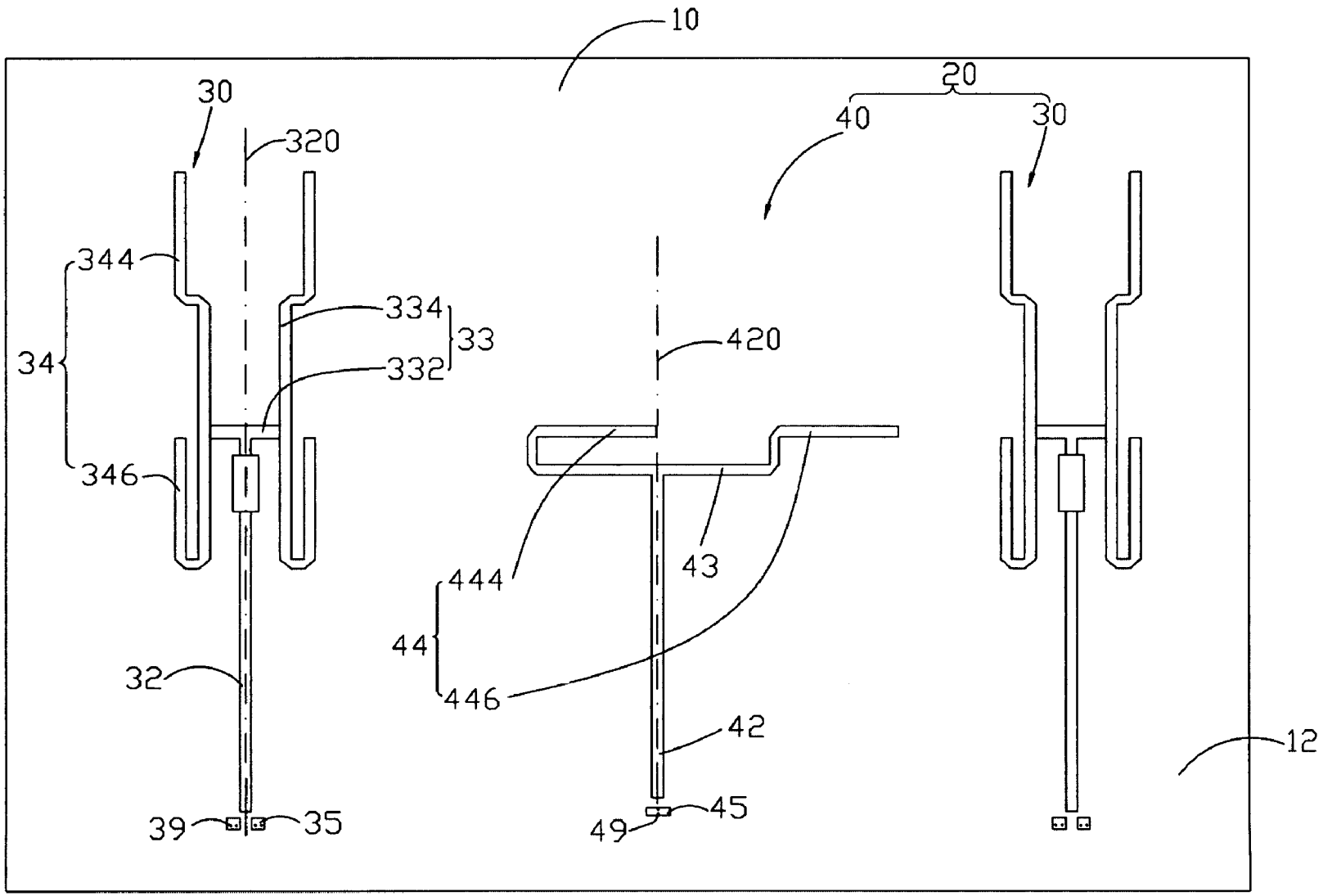
FIG. 1 is a schematic plan view of a multiple input multiple output (MIMO) antenna of an exemplary embodiment of the present invention, the MIMO antenna disposed on a substrate and including a pair of first antennas and a second antenna.

FIG. 1 is a schematic plan view of a multiple input multiple output (MIMO) antenna 20 of an exemplary embodiment of the present invention. The MIMO antenna 20 is disposed on a substrate 10. In the exemplary embodiment, the substrate 10 is a printed circuit board (PCB).

Figure 2:
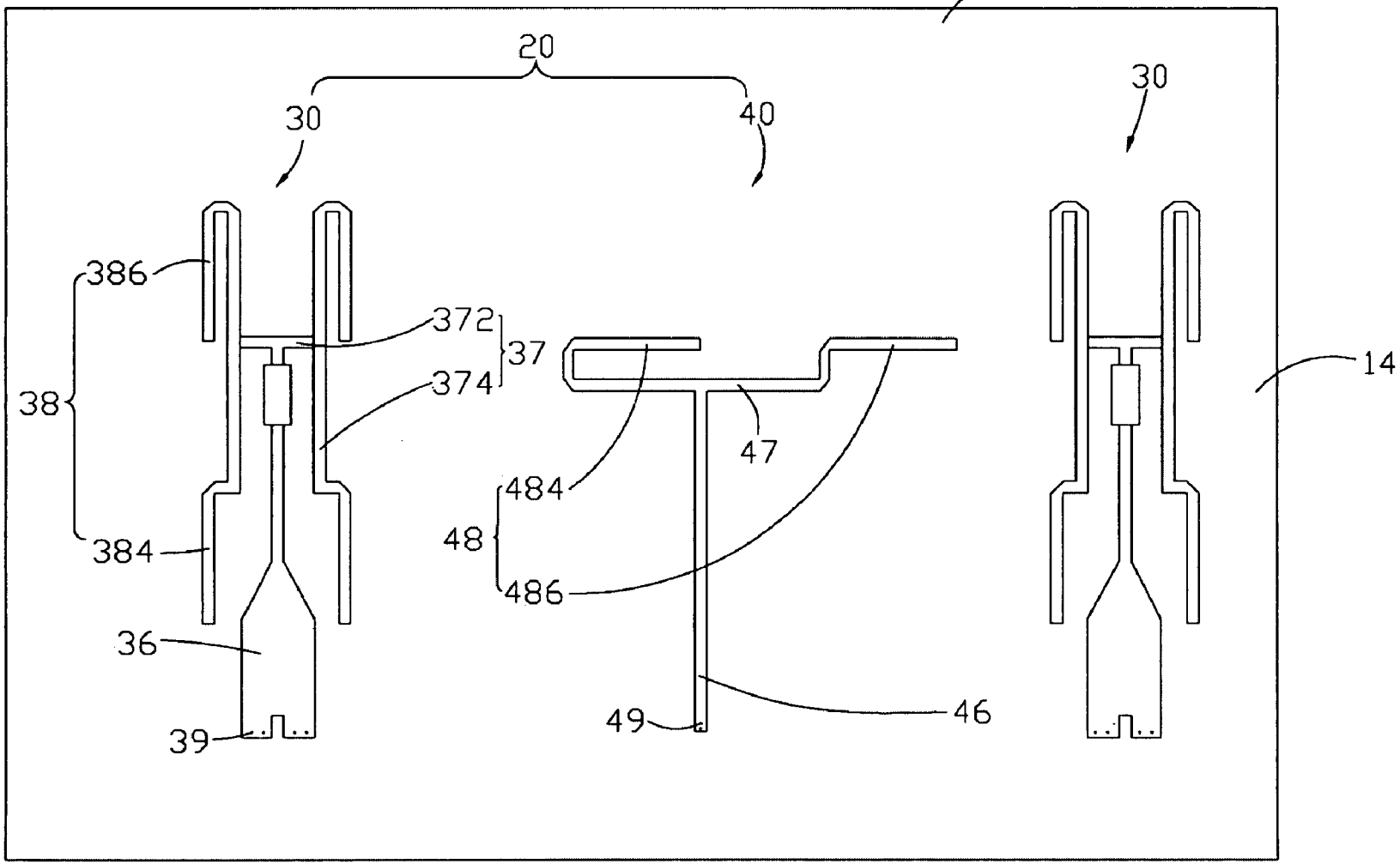
FIG. 2 is similar to FIG. 1, but viewed from another aspect.

Referring also to FIG. 2, the substrate 10 comprises a first surface 12 and a second surface 14 parallel to the first surface 102.

The MIMO antenna 20 comprises a pair of first antennas 30 and a second antenna 40. Each of the first antennas 30 and the second antenna 40 is a dipole antenna. The first antennas 30, parallel and spaced apart from each other, are defined as a vertical polarization antenna of the MIMO antenna 20, respectively, while the second antenna 40 is defined as a horizontal polarization antenna of the MIMO antenna 20. The second antenna 40 is located between and spaced apart from the first antennas 30.

Each of the first antennas 30 comprises a feeding portion 32, a power divider 33, a first radiating body 34, a pair of ground planes 35, a ground transmission line 36, a connecting body 37, and a second radiating body 38. The feeding portion 32, the power divider 33, the first radiating body 34, and the ground planes 35 are disposed on the first surface 12 of the substrate 10. The ground transmission line 36, the connecting portion 37, and the second radiating body 38 are disposed on the second surface 14 of the substrate 10.

The feeding portion 32 is electrically connected to the first radiating body 34 via the power divider 33 and feeds signals to the first radiating body 34. The feeding portion 32 is a 50 Ohm (Ω) transmission line.

The first radiating body 34 transmits and receives radio frequency (RF) signals. The first radiating body 34 is symmetrical about a central line 320 of the feeding portion 32 and comprises a pair of parallel first radiating portions 344, and a pair of parallel second radiating portions 346. The first radiating portions 344 are arranged on two sides of the power divider 33 and symmetrical about the central line 320 of the feeding portion 32. The second radiating portions 346 are arranged on two sides of the power divider 33 and symmetrical about the central line 320 of the feeding portion 32. A length of each of the first and second radiating portions 344 and 346 is generally one-fourth the wavelength of the RF signal. Each of the first radiating portions 344 is aligned with each of the second radiating portions 346 on the same side of the power divider 33 as the first radiating portions 344.

The power divider 33 is electrically connected to the feeding portion 32 and is symmetrical about the central line 320 of the feeding portion 32. The power divider 33 feeds signals to the first radiating portions 344 and the second radiating portion 346. The power divider 33 generally has a substantially H-shaped profile and comprises a first connecting portion 332 and a pair of second connecting portions 334 each electrically connected to the first connecting portion 332. The first connecting portion 332 is electrically connected to the feeding portion 32 and is symmetrical about the central line 320 of the feeding portion 32. The second connecting portions 334 each have a C-shaped profile and are symmetrically arranged on two sides of the first connecting portion 332.

The ground planes 35 are symmetrical about the central line 320 of the feeding portion 32. Each of the ground planes 35 is electrically connected to the ground transmission line 36 through a pair of vias 39. The ground transmission line 36 is symmetrical about a projection of the central line 320 of the feeding portion 32 on the second surface 14 of the substrate 10.

In other embodiments, each first antenna 30 can comprise a ground plane 35. Each ground plane 35 comprises a via 39 and is electrically connected to the ground transmission line 36 through the via 39.

The second radiating body 38 is coupled to the first radiating body 34 to transmit and receive the RF signals. The second radiating body 38 is electrically connected to the connecting body 37 and is symmetrical about the projection of the central line 320 of the feeding portion 32 on the second surface 14 of the substrate 10. The second radiating body 38 comprises a pair of parallel third radiating portions 384 and a pair of parallel fourth radiating portions 386. The third radiating portions 384 are arranged on two sides of the connecting body 37 and are symmetrical about the projection of the central line 320 of the feeding portion 32 on the second surface 14 of the substrate 10. The fourth radiating portions 386 are arranged on two sides of the connecting body 37 and are symmetrical about the projection of the central line 320 of the feeding portion 32 on the second surface 14 of the substrate 10. The length of each of the third and fourth radiating portions 384 and 386 is generally one-fourth the wavelength of the RF signal. Each of the third radiating portions 384 is aligned with each of the fourth radiating portions 386 arranged on the same side of the connecting body 37 as the third radiating portions 384.

In the exemplary embodiment, the first radiating portions 344 of the first radiating body 34 are respectively coupled to the fourth radiating portions 386 of the second radiating body 38, and the second radiating portions 346 of the first radiating body 34 are respectively coupled to the third radiating portions 384 of the second radiating body 38, thereby generating a dipole antenna array including four antennas. The dipole antenna array improves the gain and function of the radiation of the first antenna 30. Additionally, the first antenna 30 has a low profile and a small size because of the dipole antenna array.

In other embodiments, the first and second radiating portions 34 and 38 only comprise a radiating portion.

The connecting body 37 is electrically connected to the ground transmission line 36 and is symmetrical about the projection of the central line 320 of the feeding portion 32 on the second surface 14 of the substrate 10. The connecting body 37 is substantially H-shaped and comprises a third connecting portion 372 and a pair of fourth connecting portions 374. The third connecting portion 372 is electrically connected to the ground transmission line 36 and is symmetrical about the projection of the central line 320 of the feeding portion 32 on the second surface 14 of the substrate 10. The fourth connecting portions 374 each have a C-shaped profile and are symmetrically arranged on two sides of the third connecting portion 372.

The second antenna 40 comprises a feeding portion 42, a power divider 43, a first radiating body 44, a ground plane 45, a ground transmission line 46, a connecting body 47, and a second radiating body 48. The feeding portion 42, the power divider 43, the first radiating body 44, and the ground planes 45 are located on the first surface 12 of the substrate 10. The ground transmission line 46, the connecting portion 47, and the second radiating body 48 are disposed on the second surface 14 of the substrate 10.

The feeding portion 42 is electrically connected to the first radiating body 44 via the power divider 43 and feeds signals to the first radiating body 44. The feeding portion 42 is a 50Ω transmission line.

The first radiating body 44 transmits and receives radio frequency (RF) signals and comprises a first radiating portion 444 and a second radiating portion 446. The length of each of the first and second radiating portions 444 and 446 is generally one-fourth the wavelength of the RF signal. The first radiating portion 444 is aligned with and spaced apart from the second radiating portion 446.

The power divider 43 is electrically connected to the feeding portion 42 and is symmetrical about the central line 420 of the feeding portion 42. The power divider 43 feeds signals to the first radiating portion 444 and the second radiating portion 446. The power divider 43 is substantially C-shaped and is electrically connected to the first radiating portion 444 and the second radiating portion 446.

The ground plane 45 is symmetrical about the central line 420 of the feeding portion 42 and is electrically connected to the ground transmission line 46 through a pair of vias 49. The ground transmission line 46 is symmetrical about a projection of the central line 420 of the feeding portion 42 on the second surface 14 of the substrate 10.

In other embodiments, the second antenna 40 can only comprise a via 49. The ground plane 45 is electrically connected to the ground transmission line 36 through the via 49.

The second radiating body 48 is coupled to the first radiating body 44 to transmit and receive the RF signals. The second radiating body 48 is electrically connected to the connecting body 47 and is symmetrical about the projection of the central line 420 of the feeding portion 42 on the second surface 14 of the substrate 10. The second radiating body 48 comprises a third radiating portion 484 and a fourth radiating portion 486. The length of each of the third and fourth radiating portions 484 and 486 is generally one-fourth the wavelength of the RF signal. The third radiating portion 484 is aligned with and spaced apart from the fourth radiating portion 486.

In the exemplary embodiment, the first radiating portion 444 of the first radiating body 44 is coupled to the fourth radiating portion 486 of the second radiating body 48, while the second radiating portion 446 of the first radiating body 44 is coupled to the third radiating portion 484 of the second radiating body 48, thereby generating a dipole antenna array including two antennas. The dipole antenna array improves the gain and function of radiation of the second antenna 40. Additionally, the second antenna 40 has a low profile and a small size due to the dipole antenna array.

In other embodiments, the first and second radiating portions 44 and 48 comprise a radiating portion.

The connecting body 47 is electrically connected to the ground transmission line 46 and is symmetrical about the projection of the central line 420 of the feeding portion 42 on the second surface 14 of the substrate 10. The connecting body 47 is substantially C-shaped and is electrically connected to the first and second radiating portions 484 and 486.

Figure 3:
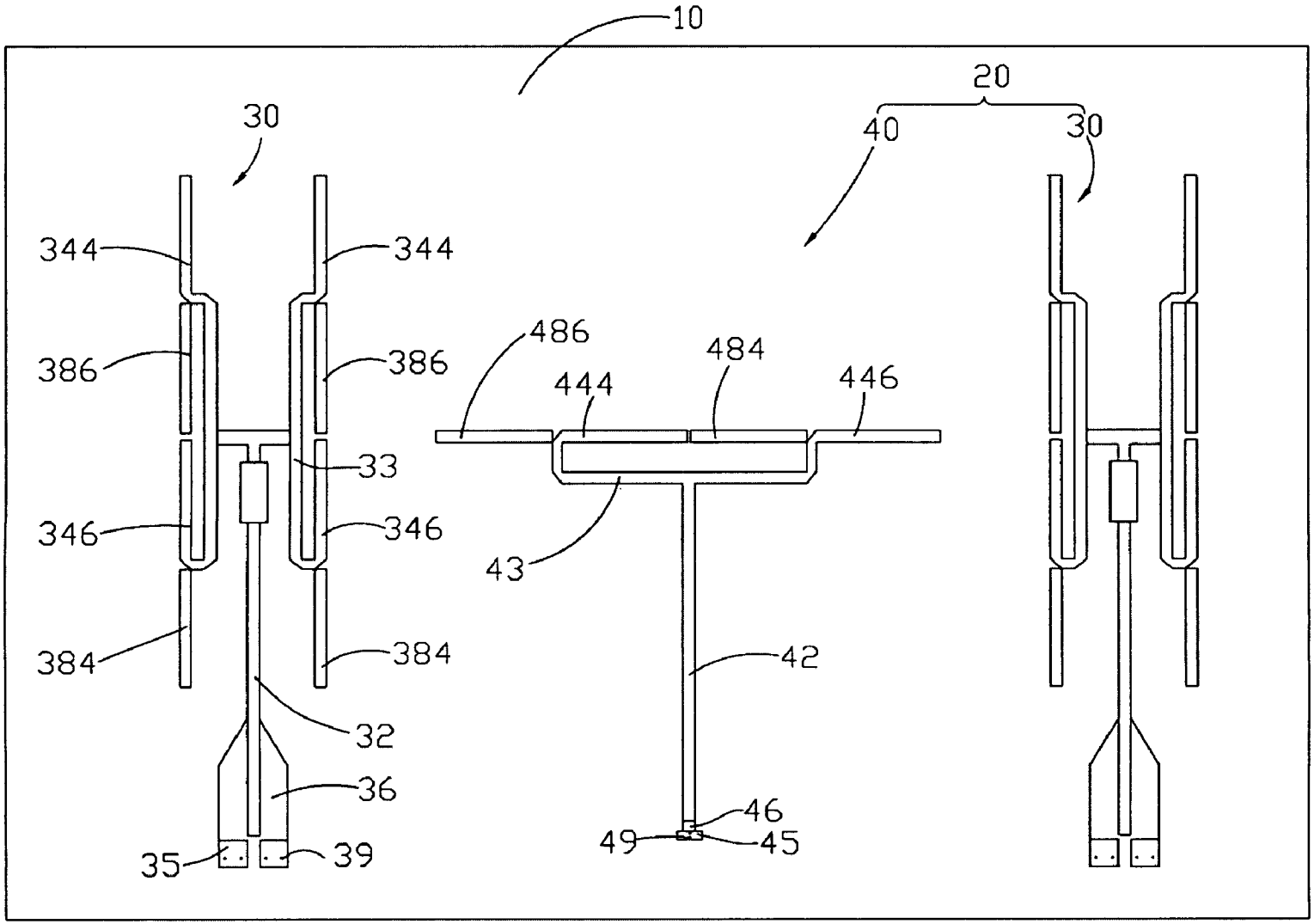
FIG. 3 is a projection plan view of the MIMO antenna on the substrate.

FIG. 3 is a projection plan view of the MIMO antenna 20 on the PCB. Projections of the first antennas 30 on the substrate 10 are symmetrical about a central line of a projection of the second antenna 40 on the substrate 10. The projection of each of the first antennas 30 on the substrate 10 is symmetrical about a projection of the central line 320 of the feeding portion 32 on the substrate 10. The projection of the second antenna 40 is symmetrical about a projection of the central line 420 of the feeding portion 42 on the substrate 10. Each of the first, second, third, and fourth radiating portions 344, 346, 384, and 386 of the first antenna 30 is disposed on the same side and aligned with each other. The first, second, third, and fourth radiating portions 444, 446, 484, and 486 are aligned with each other.

In the exemplary embodiment, the first radiating bodies 34, 44 and the second radiating bodies 38, 48 are designated as radiating bodies. The first radiating portions 344, 444, the second radiating portions 346, 446, the third radiating portions 484, 384, and the fourth radiating portions 386, 486 are designated as radiating portions.

Figure 4:
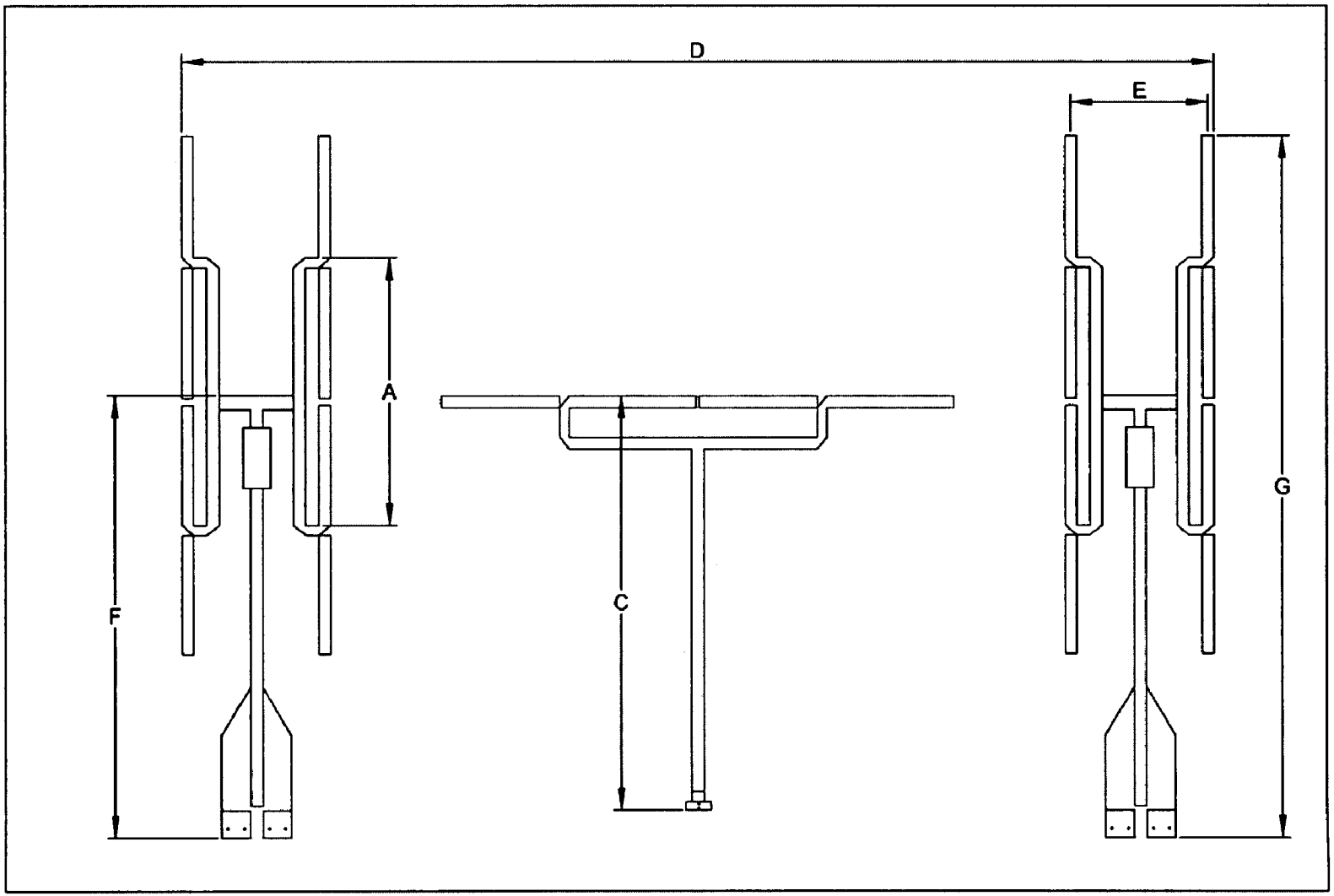
FIG. 4 is a schematic plan view illustrating dimensions of the MIMO antenna of FIG. 3.

FIG. 4 is a schematic plan view illustrating dimensions of the MIMO antenna 20 of FIG. 3. In the exemplary embodiment, length D of the MIMO antenna 20 is generally 15.1 cm and width G of the MIMO antenna 20 is generally 8.35 cm. Length A of the power divider 33 of the first antenna 30 is generally half the wavelength of the RF signal. Distance E between the first radiating portions 344 of the first antenna 30 is generally one-fourth the wavelength of the RF signal. The length of each of the radiating portions of the MIMO antenna 20 is generally one-fourth the wavelength of the RF signal. Distance F between the ground plane 35 and the first connecting portion 332 of the first antenna 30 is generally 4.7 cm. Distance C between the ground plane 45 and the first radiating portion 444 of the second antenna 40 is generally 4.7 cm.

In the exemplary embodiment, the first antenna 30 disposed on the left of the second antenna 40 is designated as a left first antenna 30 and the first antenna 30 disposed on the right of the second antenna 40 is designated as a right first antenna 30.

Figure 5:
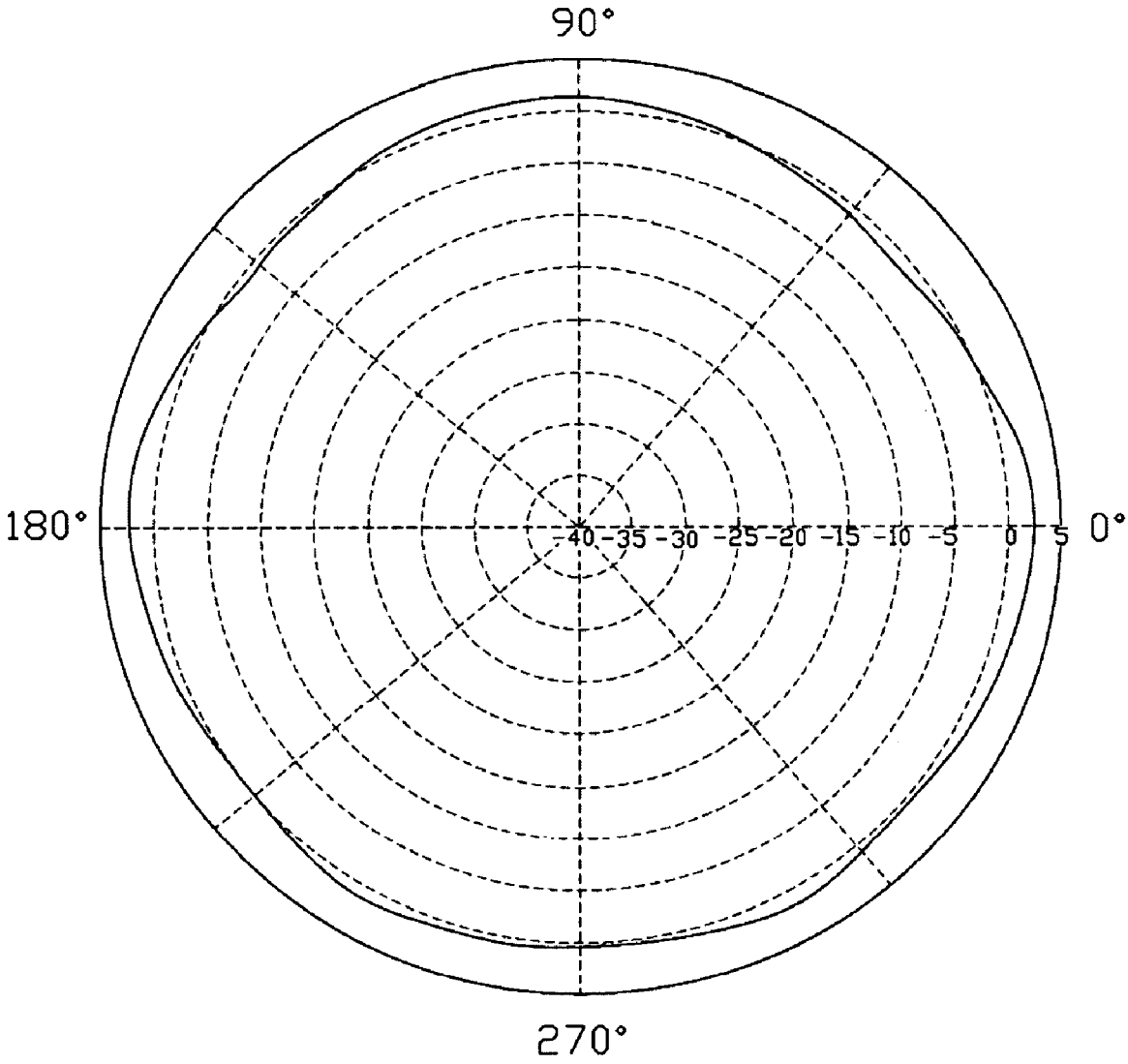
FIG. 5 is a graph of test results showing a vertical polarization radiation pattern when the first antenna disposed on the left of the second antenna is operated at 2.40 Gigahertz (GHz)
Figure 6:
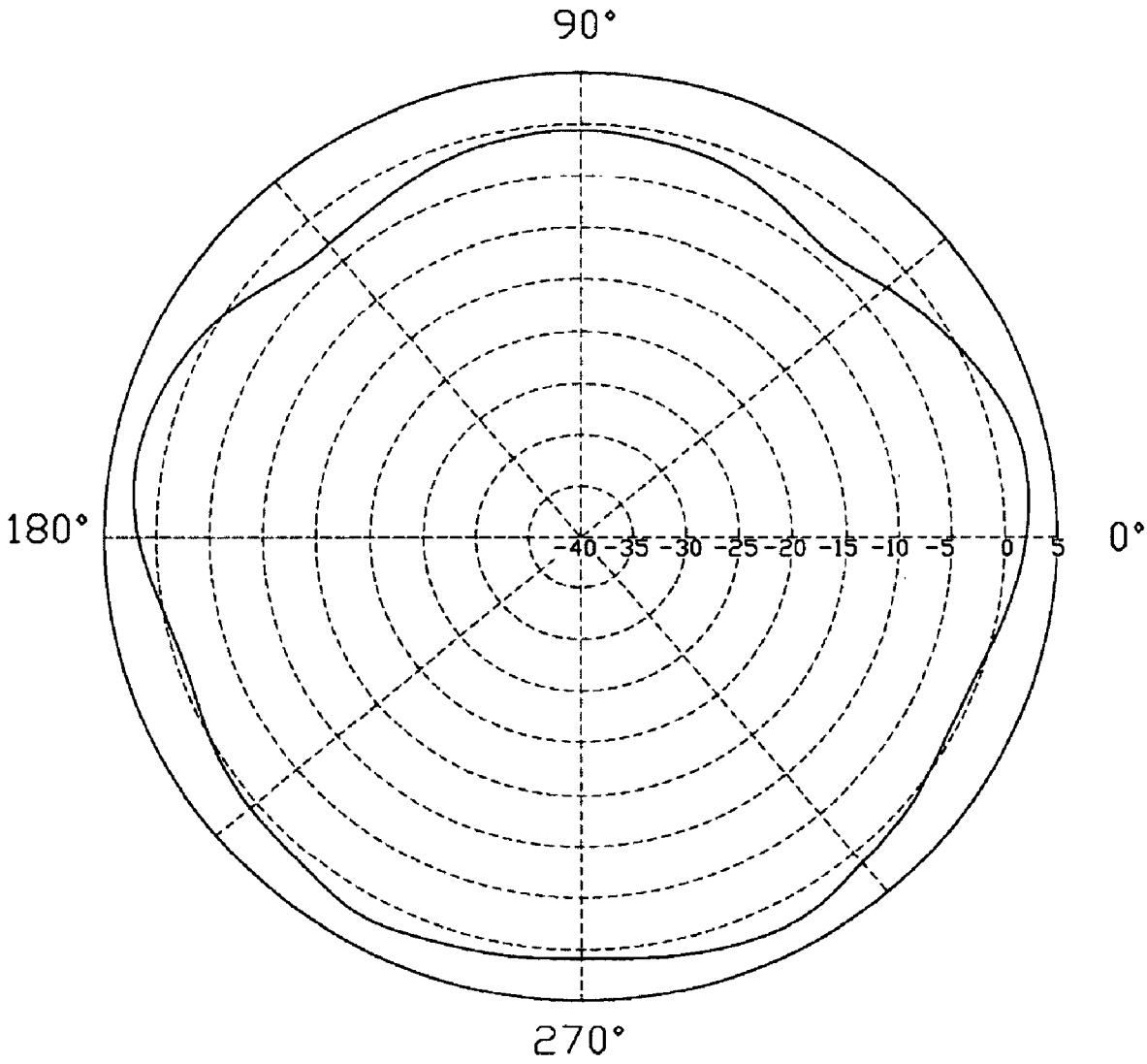
FIG. 6 is a graph of test results showing a vertical polarization radiation pattern when the first antenna disposed on the left of the second antenna is operated at 2.50 GHz.
Figure 7:
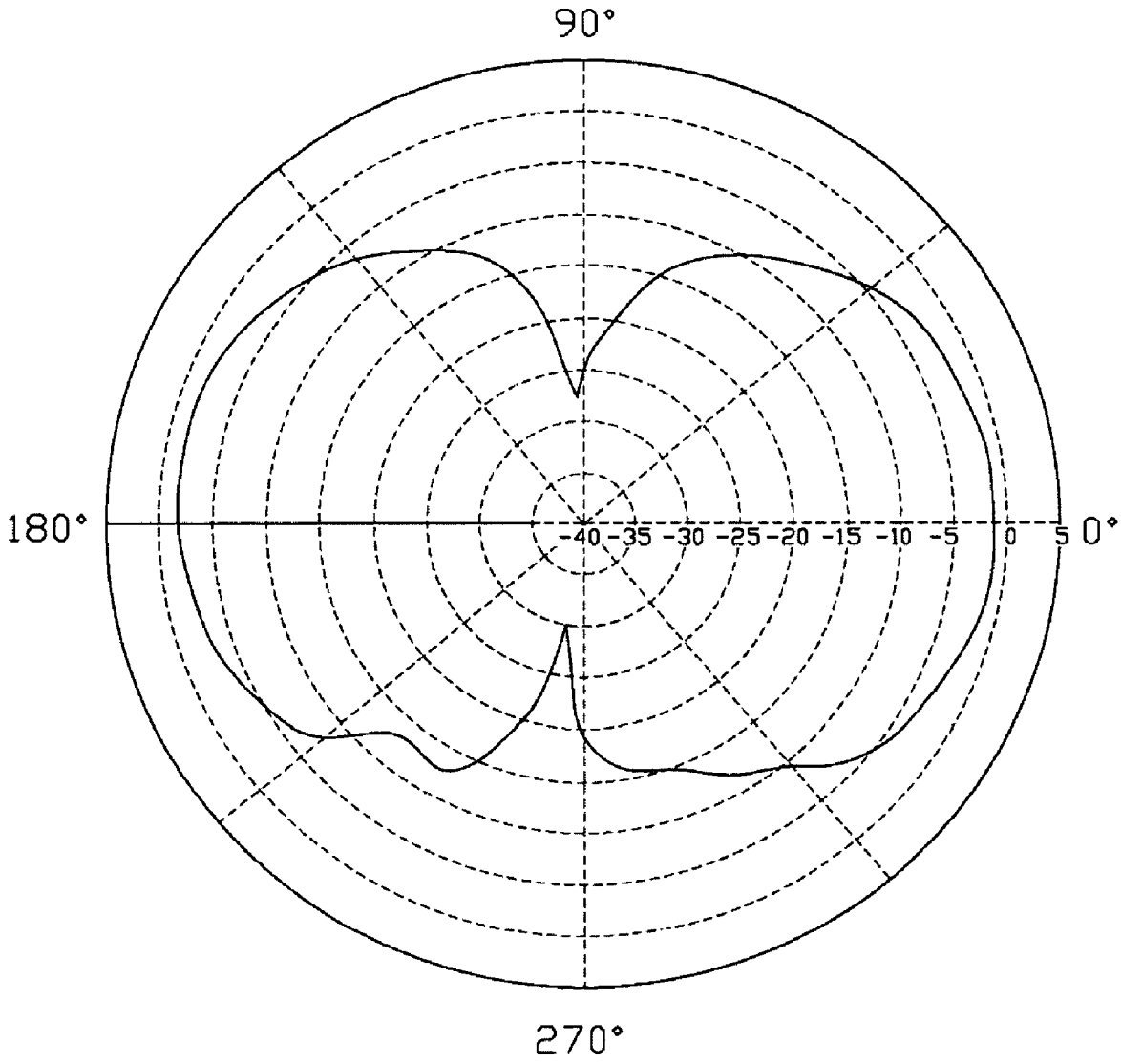
FIG. 7 is a graph of test results showing a horizontal polarization radiation pattern when the second antenna is operated at 2.40 GHz.
Figure 8:
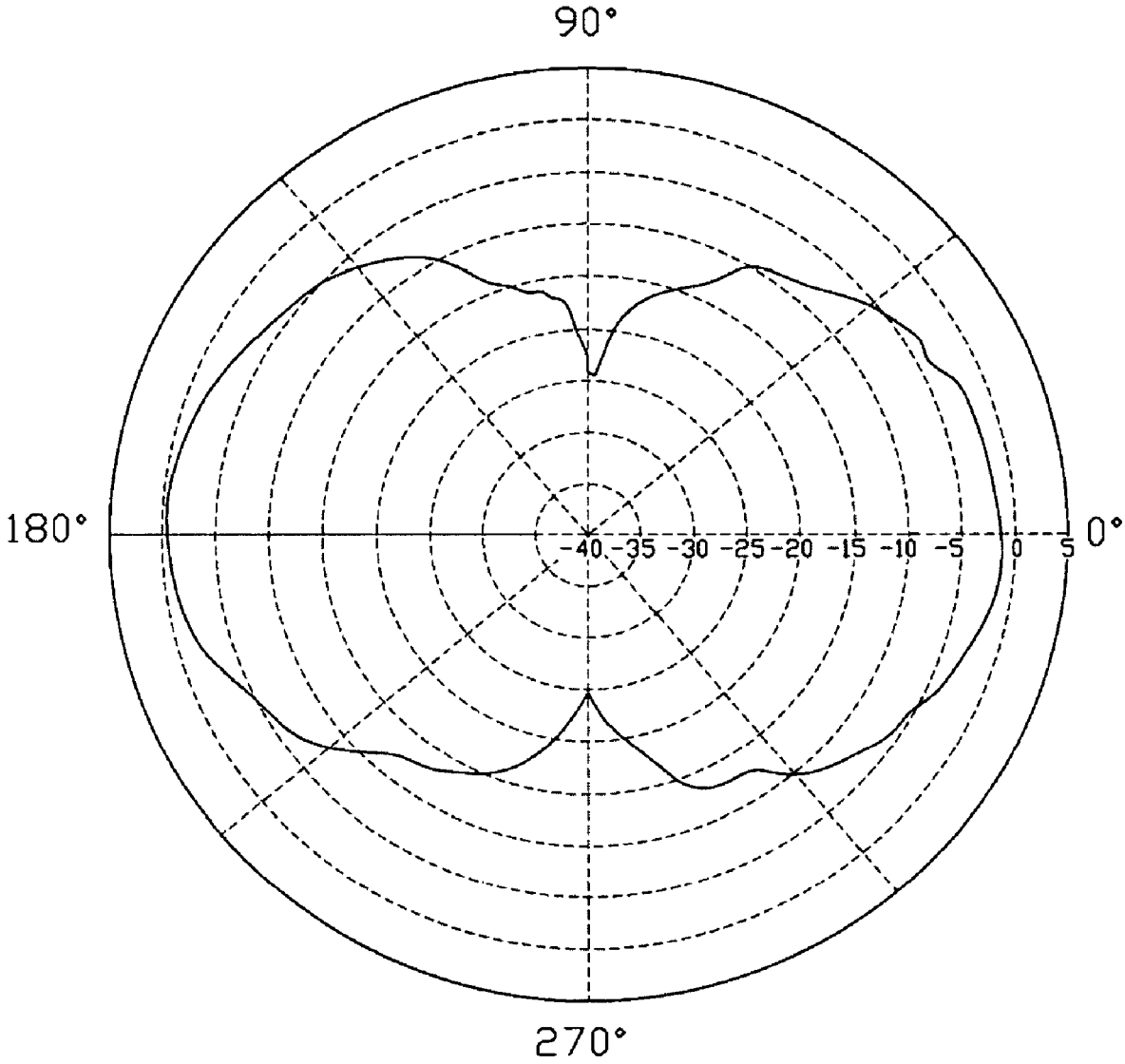
FIG. 8 is a graph of test results showing a horizontal polarization radiation pattern when the second antenna is operated at 2.50 GHz.

FIGS. 5-6 are graphs of test results showing vertical polarization radiation patterns when the left first antenna 30 is operated at 2.40 GHz and 2.50 GHz, respectively. As shown, all of the radiation patterns are substantially omni-directional and the radiation function in a vertical direction of the left first antenna 30 is satisfactory.

FIGS. 5-6 are graphs of test results showing horizontal polarization radiation patterns when the second antenna 30 is operated at 2.40 GHz and 2.50 GHz, respectively. As shown, the radiation function in a horizontal direction of the second antenna 40 is satisfactory.

Figure 9:
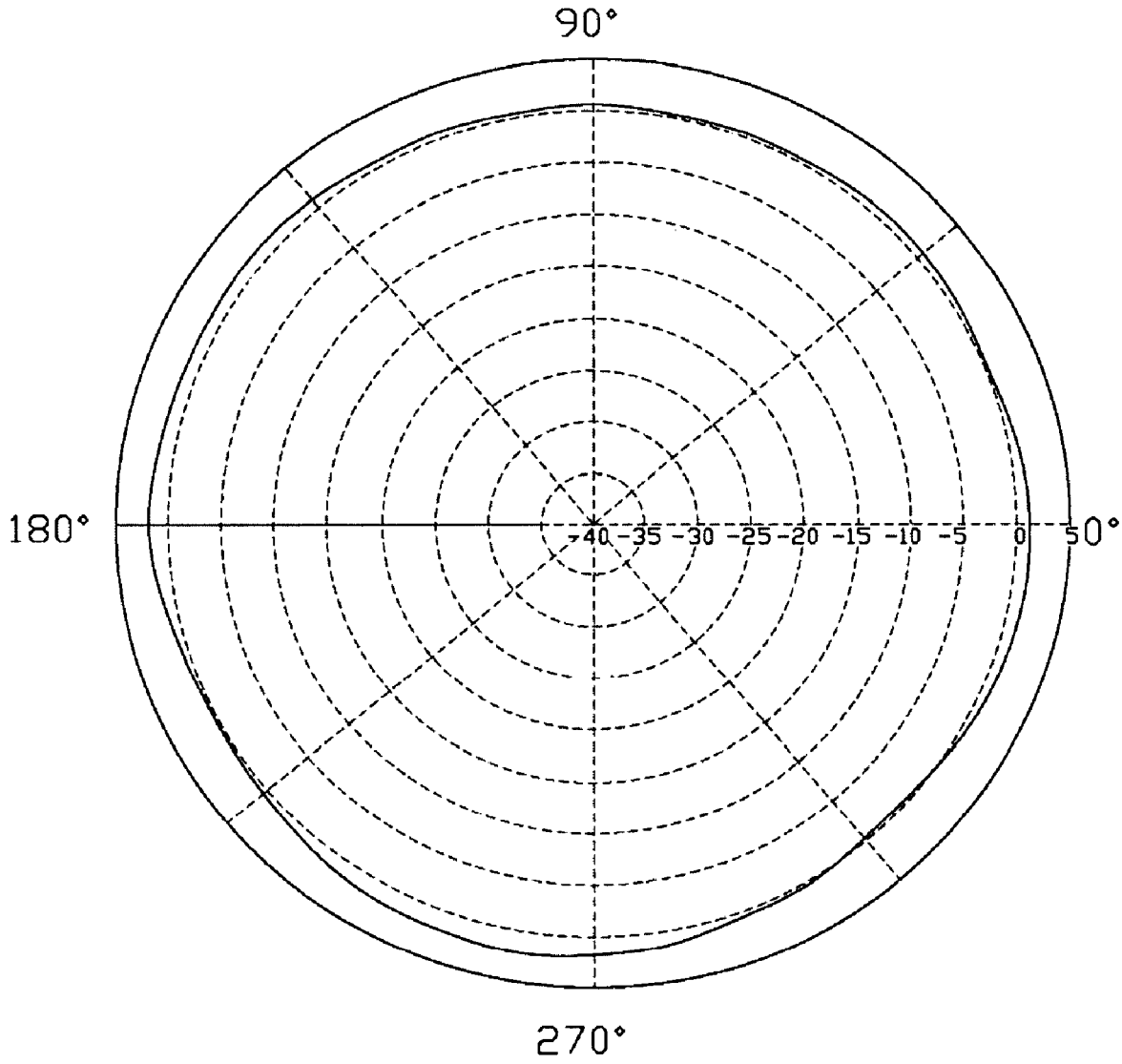
FIG. 9 is a graph of test results showing a vertical polarization radiation pattern when the first antenna disposed on the right of the second antenna is operated at 2.40 GHz.
Figure 10:
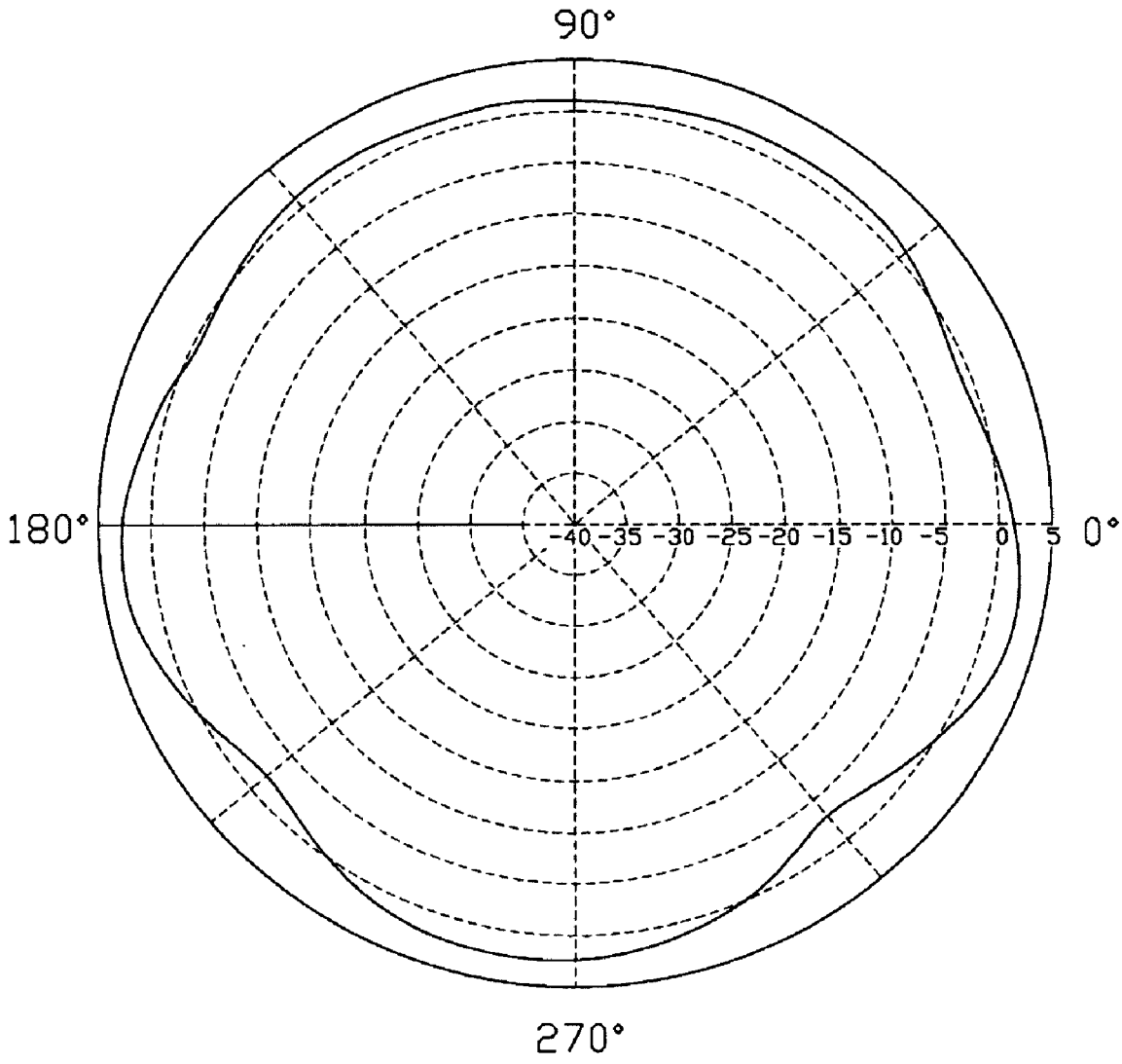
FIG. 10 is a graph of test results showing a vertical polarization radiation pattern when the first antenna disposed on the right of the second antenna is operated at 2.50 GHz.

FIGS. 9-10 are graphs of test results showing vertical polarization radiation patterns when the right first antenna 30 is operated at 2.40 GHz and 2.50 GHz, respectively. As shown, all of the radiation patterns are substantially omni-directional and the radiation function in a vertical direction of the right first antenna 30 is satisfactory.

Figure 11:
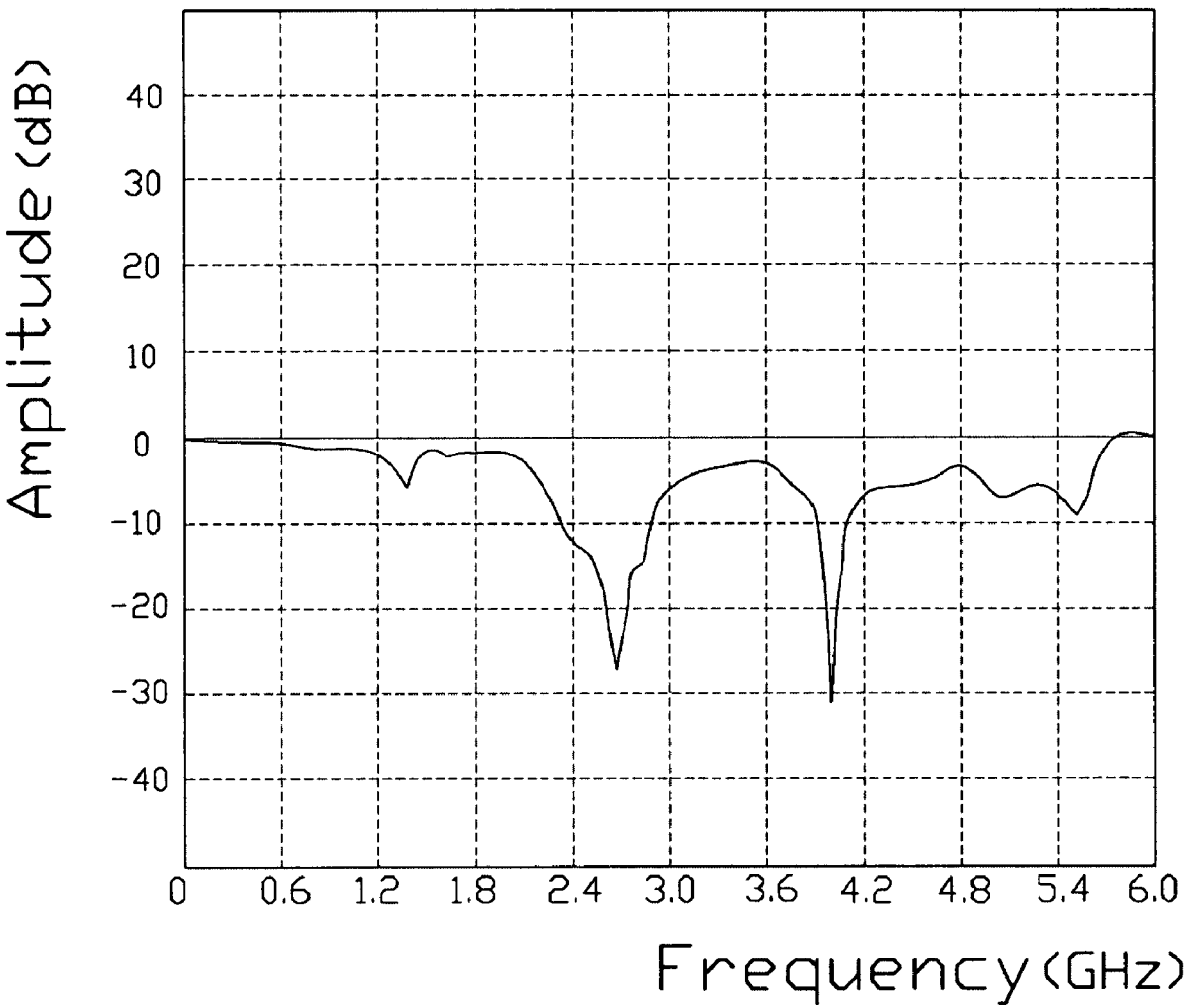
FIGS. 11, 12, and 13 are graphs of test results showing a return loss of the MIMO antenna of FIG. 1.
Figure 12:
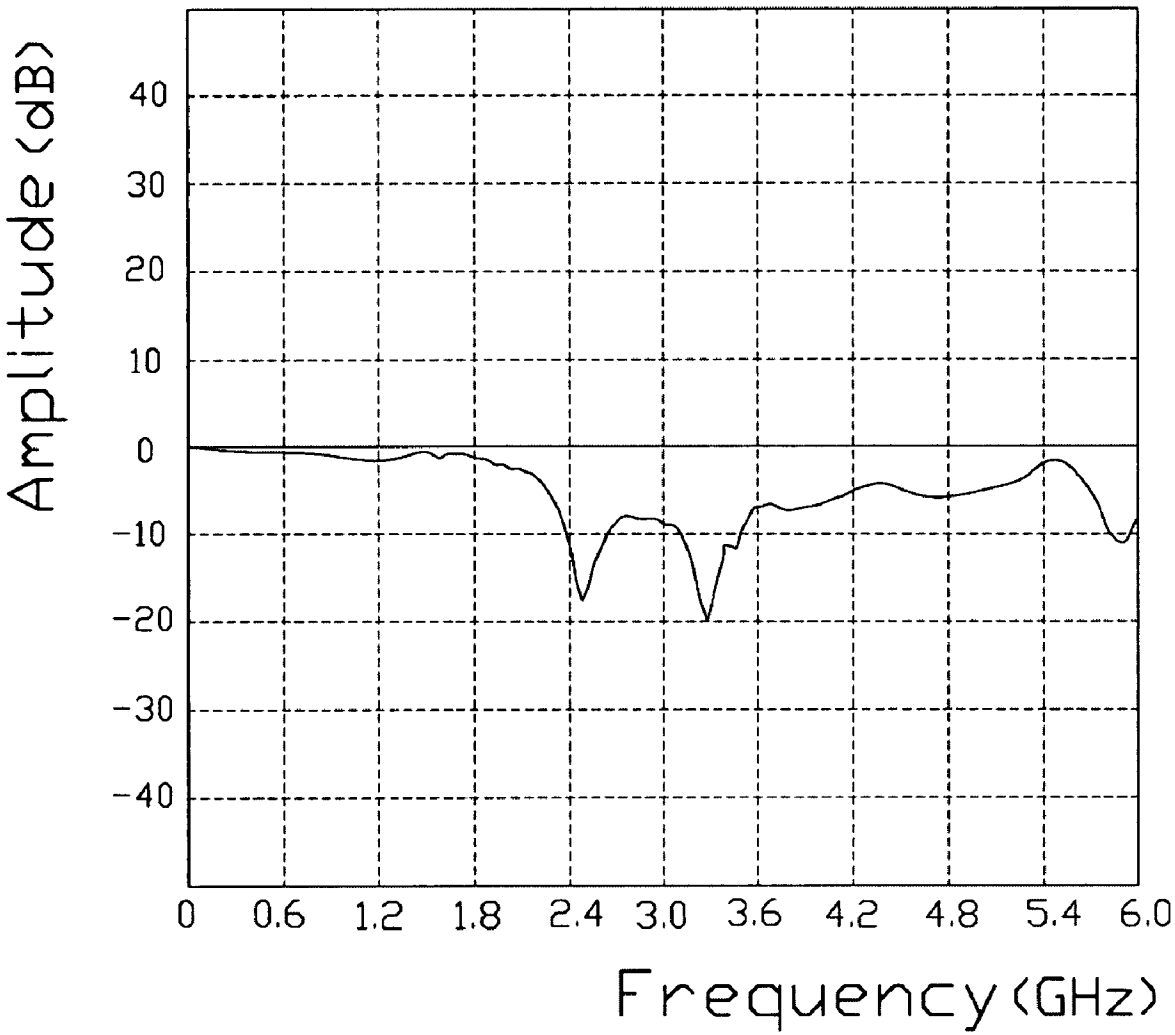
Figure 13:
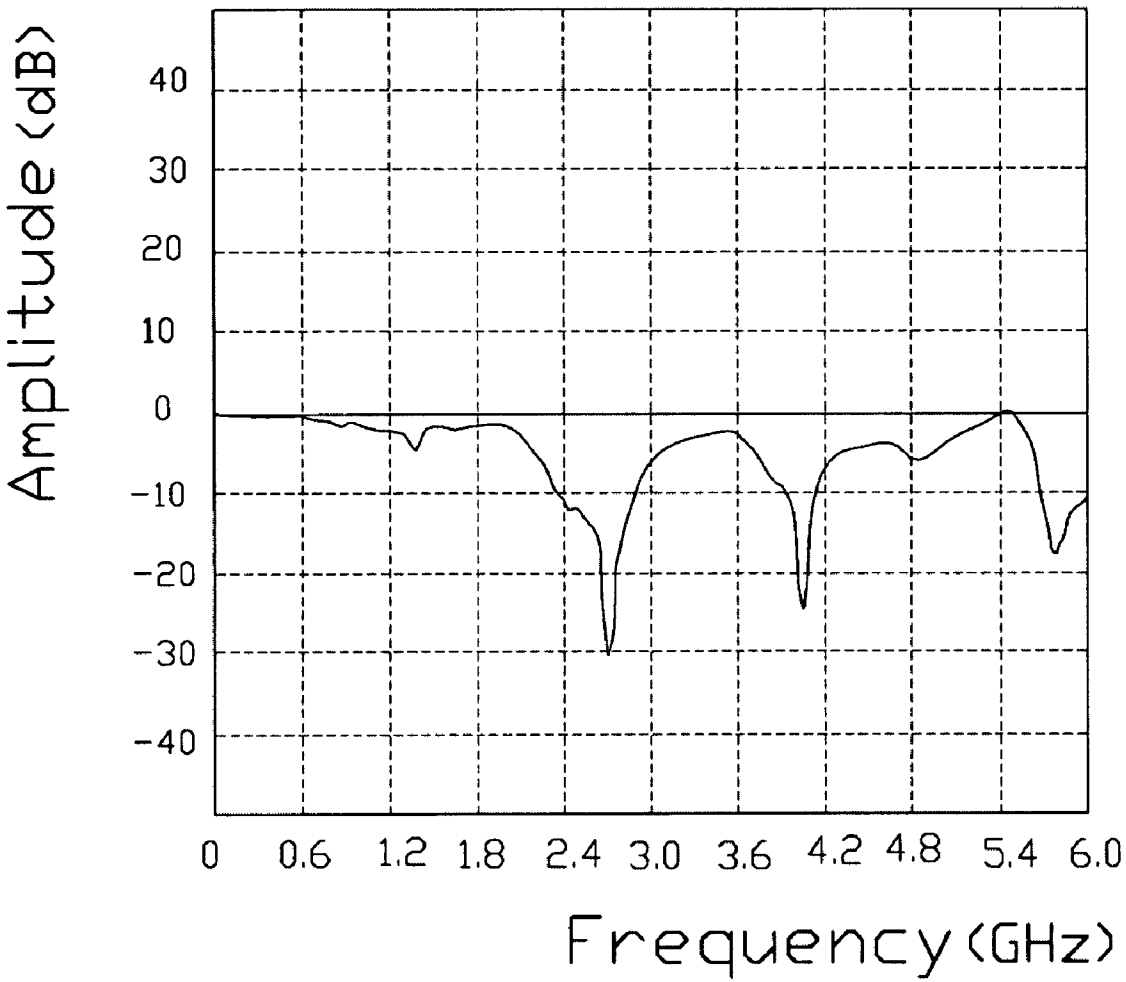

FIGS. 11, 12 and 13 are graphs of test results showing a return loss of the MIMO antenna 20 when used in a wireless communication system, with the return loss as its vertical coordinate and the frequency as its horizontal coordinate. When the MIMO antenna 20 operates at frequency bands of 2.4~2.5 GHz, the return loss drops below −10 dB, compliant with standard practical requirements.

Because the first antennas 30 are isolated by and spaced apart from the second antenna 40, frequently known as space diversity, the MIMO antenna 20 can effectively avoid RF signal fading, thereby improving the quality of its RF signal transmission.

Because the first antennas 30 have a good radiation function vertically and the second antenna 40 has a good radiation function horizontally, signal interference between the first antennas 30 and the second antenna 40 is reduced. As a result, isolation between the first antennas 30 and the second antenna 40 is improved, thereby improving the gain of the MIMO antenna 20.

In the embodiment, the first antennas 30 and the second antenna 40 are disposed on different surfaces of the substrate 200, therefore, the MIMO antenna 20 has a lower profile and a smaller size.

With the above-described configuration, the MIMO antenna 20 has a lower profile, a smaller size, a better return loss, good isolation, and good gain.

While embodiments of the present invention have been described above, it should be understood that they have been presented by way of example only and not by way of limitation. Thus, the breadth and scope of the present invention should not be limited by the above-described exemplary embodiments, but should be defined only in accordance with the following claims and their equivalents.

What is claimed is:

1. A multi input multi output (MIMO) antenna printed on a substrate comprising a first surface and a second surface, the MIMO antenna comprising:

a pair of parallel first antennas spaced apart from each other, the first antennas each disposed on the first and second surface of the substrate; and a second antenna disposed between and spaced apart from the first antennas, the second antenna disposed on the first and second surfaces of the substrate;

wherein each of the first and second antennas is a dipole antenna.

2. The MIMO antenna as claimed in claim 1, wherein each of the first and second antennas is a dipole antenna array.

3. The MIMO antenna as claimed in claim 1, wherein projections of the first antennas on the substrate are symmetrical about a central line of a projection of the second antenna on the substrate.

4. The MIMO antenna as claimed in claim 3, wherein each of the first antennas comprises a feeding portion for feeding signals thereto, a first radiating body and a second radiating body coupled to the first radiating body to transmit and receive the signals, wherein the feeding portion and the first radiating body are disposed on the first surface of the substrate, and the second radiating body is disposed on the second surface of the substrate.

5. The MIMO antenna as claimed in claim 4, wherein the projection of each of the first antennas is symmetrical about a projection of a central line of the feeding portion.

6. The MIMO antenna as claimed in claim 4, wherein the second antenna comprises a feeding portion for feeding signals thereto, a first radiating body, and a second radiating body coupled to the first radiating body to transmit and receive the signals, the feeding portion and the first radiating body disposed on the first surface of the substrate, the second radiating body disposed on the second surface of the substrate.

7. The MIMO antenna as claimed in claim 6, wherein each of the first and second radiating bodies of the first and second antennas comprises at least one radiating portion, and a length of each of the at least one radiating portion is generally one-fourth of a wavelength of the signal.

8. The MIMO antenna as claimed in claim 6, wherein the projection of the second antenna is symmetrical about a projection of a central line of the feeding portion.

9. The MIMO antenna as claimed in claim 6, wherein each of the first and second antennas further comprises a power divider disposed on the first surface feeding signals to the first radiating body.

10. The MIMO antenna as claimed in claim 9, wherein each of the first and second antennas further comprises at least one ground plane disposed on the first surface and a ground transmission line disposed on the second surface, and the at least one ground plane is electrically connected to the ground transmission line by at least one via.

11. A multi input multi output (MIMO) antenna disposed on a substrate comprising a first surface and a second surface, the MIMO antenna comprising:

a pair of parallel vertical polarization antennas spaced apart from each other, each of the vertical polarization antennas comprising a feeding portion for feeding signals thereto, a first radiating body, and a second radiating body coupled to the first radiating body to transmit and receive the signals, the feeding portion and the first radiating body disposed on the first surface of the substrate, the second radiating body disposed on the second surface of the substrate;

a horizontal polarization antenna disposed between and spaced apart from the vertical polarization antennas, the horizontal polarization antenna comprising a feeding portion for feeding signals thereto, a first radiating body, and a second radiating body coupled to the first radiating body to transmit and receive the signals, the feeding portion and the first radiating body disposed on the first surface of the substrate, the second radiating body disposed on the second surface of the substrate;

wherein, each of the vertical and horizontal polarization antennas is a dipole antenna.

12. The MIMO antenna as claimed in claim 11, wherein each of the vertical and horizontal polarization antennas is a dipole antenna array.

13. The MIMO antenna as claimed in claim 12, wherein projections of the vertical polarization antennas on the substrate are symmetrical about a central line of a projection of the horizontal polarization antenna on the substrate.

14. The MIMO antenna as claimed in claim 13, wherein the projection of each of the vertical polarization antennas is symmetrical about a projection of a central line of the feeding portion.

15. The MIMO antenna as claimed in claim 13, wherein the projection of the horizontal polarization antennas is symmetrical about a projection of a central line of the feeding portion.

16. The MIMO antenna as claimed in claim 11, wherein each of the first and second radiating bodies of the vertical and horizontal polarization antennas comprises at least one radiating portion, and a length of the at least one radiating portion is generally one-fourth of the wavelength of the signal.

17. The MIMO antenna as claimed in claim 16, wherein each of the vertical and horizontal polarization antennas comprises a power divider disposed on the first surface feeding signals to the first radiating body.

18. The MIMO antenna as claimed in claim 17, wherein each of the horizontal and vertical polarization antennas comprises at least one ground plane disposed on the first surface and a ground transmission line disposed on the second surface, and the at least one ground plane is electrically connected to the ground transmission line by at least one via.

* * * * *